US006152447A

United States Patent [19]

Stanley

[11] Patent Number: 6,152,447

[45] Date of Patent: Nov. 28, 2000

[54] AMUSEMENT MACHINE INCLUDING A GAME OF CHANCE IN COMBINATION WITH A CRANE GAME OPERABLE IN RESPONSE TO A WIN ON THE GAME OF CHANCE

[75] Inventor: Mark Henry Stanley, Sutton Coldfield, United Kingdom

[73] Assignee: Showcase Projects Ltd., Birmingham, United Kingdom

[21] Appl. No.: 09/194,877

[22] PCT Filed: Jun. 3, 1997

[86] PCT No.: PCT/GB97/01500

§ 371 Date: Dec. 4, 1998

§ 102(e) Date: Dec. 4, 1998

[87] PCT Pub. No.: WO97/46988

PCT Pub. Date: Dec. 11, 1997

[30] Foreign Application Priority Data

Jun. 7, 1996 [GB] United Kingdom ..... 9611908

[51] Int. Cl.[7] ..... G07F 17/32

[52] U.S. Cl. ..... 273/138.1; 273/448; 273/142 R

[58] Field of Search ..... 273/440, 447, 273/448, 454, 459, 460, 138.1, 142 R, 142 H

[56] References Cited

U.S. PATENT DOCUMENTS

| | | | |
|---|---|---|---|
| 1,938,834 | 12/1933 | Graf . | |
| 2,011,574 | 8/1935 | Fleischer . | |
| 5,397,134 | 3/1995 | Fishman et al. | 273/448 X |
| 5,527,044 | 6/1996 | Lee et al. | 273/448 |
| 5,653,446 | 8/1997 | Lin | 273/447 |
| 5,678,823 | 10/1997 | Chaffee et al. | 273/448 X |
| 5,711,530 | 1/1998 | Lewis | 273/448 |
| 5,855,374 | 1/1999 | Shoemaker, Jr. | 273/447 |

FOREIGN PATENT DOCUMENTS

| | | | |
|---|---|---|---|
| 40/6319869 | 11/1994 | Japan | 273/448 |
| 489 862 | 9/1938 | United Kingdom . | |
| 2223179 | 4/1990 | United Kingdom | 273/448 |
| 2 292 246 | 2/1996 | United Kingdom . | |
| 92/08530 | 5/1992 | WIPO | 273/447 |

*Primary Examiner*—Raleigh W. Chiu
*Attorney, Agent, or Firm*—Nixon & Vanderhye P.C.

[57] ABSTRACT

An amusement machine, with prizes, combines a game of chance with a game of skill. The game of skill incorporates a crane mechanism to grab a prize. A win on the game of chance allows the player to operate the crane mechanism of the game of skill.

10 Claims, 2 Drawing Sheets

AMUSEMENT MACHINE INCLUDING A GAME OF CHANCE IN COMBINATION WITH A CRANE GAME OPERABLE IN RESPONSE TO A WIN ON THE GAME OF CHANCE

CROSS REFERENCE TO RELATED APPLICATION

This application is a U.S. national phase of PCT/GB97/01500 filed Jun. 3, 1997.

BACKGROUND AND SUMMARY OF THE INVENTION

The invention relates to an amusement machine and in particular to one in which a player activates a crane in a housing or cabinet in an attempt to pick up a prize from a selection of prizes and carry it to an outlet. In use, the player controls movement of a conventional crane by pressing a combination of buttons or operating a joystick. These buttons move the grab mechanism along a track in the roof of the housing front to back, side to side. The crane always starts from position which is generally at the front of the machine. The crane then moves towards the back of the machine, travelling in a track along an overhead gantry. The player stops the crane in a desired position on its rearward travel. The player now directs the grab towards the right. If the player moves the grab too far right he may move it left again. When the crane is over the desired prize a button to lower the grab device is depressed. The grab is lowered and attempts to pick up the prize. Whether a prize is picked up or not the grab now has to ascend. The crane on the gantry now has to move left towards the edge of the cabinet, then moves forward to front of cabinet. The grab device now opens to deposit prize in an outlet or receptacle. The crane is now ready for the next game. In one specific system, the machine includes a large electro/mechanical hand which is designed to pick up an item. This hand can be moved in various directions by gears and pulleys and is controlled by the central processing unit. Upon insertion of a coin or token into the coin receiving slot a player will gain control of the electro/mechanical hand apparatus by using a set of control buttons or a joystick for a predetermined length of time to move the hand to try to position the hand over the prize. When in position over the desired prize, the user presses a button and the fingers of the hand open, the hand now descends to the floor of the case, the fingers close trying to grab the prize and the hand moves to an outlet chute. the fingers now open as if they are releasing a prize. The electro/mechanical hand then returns to its predetermined stationary position for the next play. The apparatus involves skill and judgement to control the hand and pick up and deposit a prize into the receptacle.

Another apparatus is commonly known as a "fruit machine" and includes a number of drums, typically three, mounted on independent axles in horizontal alignment behind respective windows in a front panel. Each drum has a number of symbols arranged around its periphery. Upon insertion of a coin or token into a coin receiving slot and actuation of a control button, the drums are caused to rotate. Rotation of the drum is controlled by a central processing unit which will stop each drum independently of the others. Where a specific combination of symbols is aligned and displayed on the windowed panel, the machine will pay out a predetermined monetary prize. The apparatus may include a display panel having flashing lights and illuminated pictures and further chances of winning are provided which involve, for example, stopping a flashing light over a particular design. Additional rewards may be granted in the form of free games or "nudges" where one or more drums are moved forward to display the next symbol in an attempt to obtain a winning combination of symbols.

In patent specification GB-A-2292246 (incorporated herein by reference) there is described and claimed an amusement apparatus comprising a machine having a game of chance in combination with a machine having a game of skill and a central processing unit, in which the central processing unit is arranged to present a minimum number of wins relative to the games paid for on the game of chance machine, one of the wins being arranged to enable play of the game of skill, the central processing unit also being arranged to adjust the number of wins on the game of chance machine according to the number of wins on the game of skill machine.

Preferably, the central processing unit is arranged to present a selected proportion of wins which enable the game of skill.

Preferably the game of chance is an amusement with prize machine and the game of skill is a crane machine. Preferably the crane machine includes an outlet for the presentation of a prize, and the chute includes a sensor to sense the passage of a prize out of the outlet or the absence of such passage to transmit that information to the central processing unit.

Preferably each machine has its own central processing unit and the units are connected to each other directly or via a master central processing unit or one master unit may be present.

The crane disclosed in GB-A-2292246 is of a traditional and conventional design. This design is of slow action which has proved to be incompatible with a fruit machine. The overall game cycle, i.e. the period from coin insertion to play the machine, finish with a specific game, until next coin insertion needs to be quick.

It is an object of this invention to provide a crane mechanism which is fast in operation and is particularly applicable to a machine having both fruit machine and amusement with prizes features.

According to the present invention in one aspect there is provided an amusement-with-prizes machine including a cabinet containing a table on which can be placed a selection of prizes, and a crane mechanism, the crane mechanism comprising a column located at one side of the table, a crane arm mounted on the column, grab means being present adjacent one end of the arm, power means for moving the crane arm from a storage position remote from the table to an operating position overlying the table, means for actuating the grab means, power means for moving the crane arm to an outlet and for returning the crane arm to the storage position.

Preferably the column is caused to move along an arcuate path to move the crane arm between the storage position and the operating position.

Preferably the table is a turntable.

Preferably the machine incorporates apparatus for playing a game of chance a win of which allows the player to operate the crane mechanism.

In a preferred feature the game of chance comprises a casing having a plurality of rotatable drums mounted therein, each drum having symbols arranged about its outer peripheral face, means to actuate rotation of the drums; means to control and stop rotation of each drum independently of the others; the casing having a window corresponding to each drum whereby to display the symbols; at least one combination of symbols indicating a win situation; means to detect a win situation and thereby grant a prize, in combination with a game of skill which comprises a transparent case, prizes arranged on the floor of the case; a movable arm to grab a prize and to dispense a won prize via an outlet.

Under the British Gaming Act, an amusement with prizes machine must be arranged to provide a proportion of the stake money as prizes, in the form of money or money-sworth. When the amusement with prizes game results in a win which enables the crane machine, there is a risk that the player will not have sufficient skill or luck to win a prize in that game, as a result of which he will receive no prize. This will upset the ratio of prizes dispensed compared to the money staked. It is accordingly a preferred feature of the invention that the outlet chute of the crane machine includes a sensor e.g. a micro switch to sense whether a prize is won or not won and to transmit that information to the central processor which can accordingly adjust the proportion of prizes to be given by the amusement with prizes machine to the required minimum.

The crane game is played a sensor in the outlet below the receptacle detects whether or not a prize has been won and passes that information to the CPU. If no prize has been won, the CPU adjusts the proportion of cash prizes on the AWP so that the minimum payout required by law is achieved.

DETAILED DESCRIPTION OF THE DRAWINGS

Figure 1:
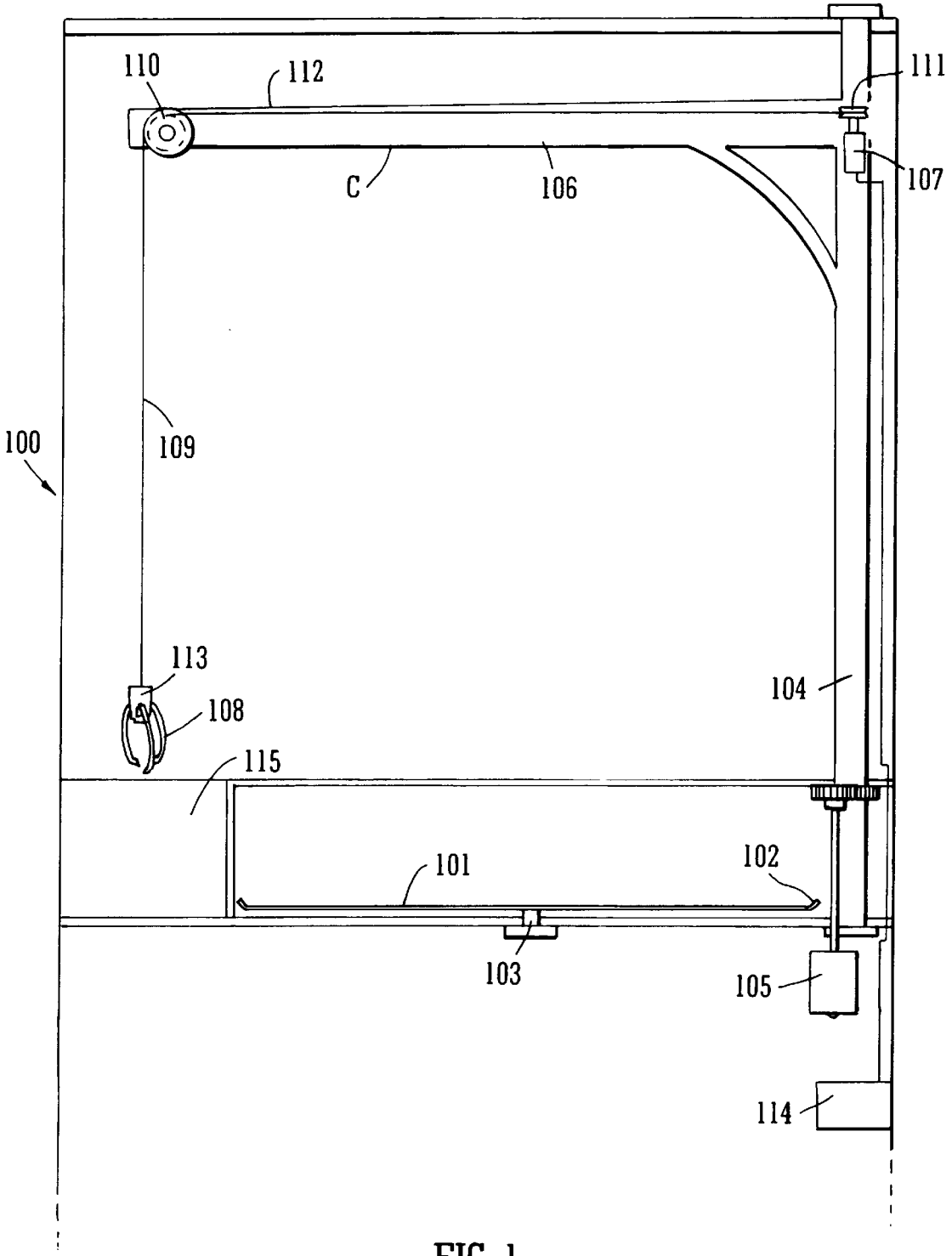
FIG. 1 is a front elevation of one amusement machine according to the invention.

The basic structure of the machine is as shown in FIG. 1 of GB-A-2292246 and for this reason will not be described in detail here.

As shown in FIG. 1 of this disclosure, the transparent case 100 contains a rotary disc 101 mounted on a vertical axle 103 at a small distance away from the floor of the case 100. The disc 101 includes a narrow wall 102 around its periphery. A number of prizes (not shown) are placed on the disc and are retained by the wall and are forced into the centre of the disc by barriers not shown.

Figure 2:
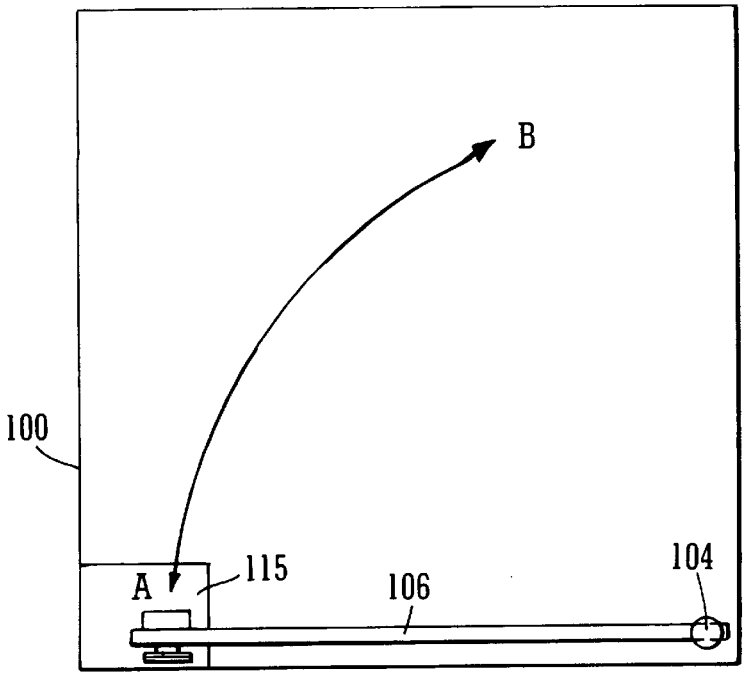
FIG. 2 is a plan view of the machine of FIG. 1.

A long vertical column or rod 104 is mounted in bearings (not shown) at the top and bottom of the cabinet. The purpose of these bearings is to allow the rod 104 to turn through the arc as shown in FIG. 2 along paths A, B. This rod is mounted to the right and front of the cabinet. Below this rod and the bearings and out of sight of the players is a DC motor 105 arranged to rotate the rod through the defined arc. A crane arm 106 is mounted towards the top of this rod 104 extending beyond the rod. Another DC motor 107 is mounted on the arm adjacent to the rod 104. A grab mechanism comprising a hand 108 is present at the free end of the arm to pick up the prizes. Running along the top of this arm is a nylon cable 109 which passes over a pulley wheel 110 and is connected to the grab mechanism 108 at one end and a pulley 111 which is mounted on top of the DC motor 107. The motor 107 is arranged to raise and lower the grab 108 by winding in and out the cable 109. A ribbon cable 112 also runs along the top of the crane arm 106. This cable is connected to a coil 113 in the grab mechanism 108 and a processor unit 114 at the base of the machine. The resistance of this coil may be altered so that the fingers of the hand 108 hold the prize lightly or strongly, thereby carrying the prize to the receptacle 115 or dropping the prize in a no win situation.

In use the prizes are placed on the disc 101 which is rotated anti clockwise; the grab arm 108 starts above payout receptacle at position A shown in FIG. 2; the player presses a button 203 (see FIG. 3) and the crane arm 106 swings away through an arc towards centre of machine position B where it overlies the disc 101. The grab mechanism 108 is lowered, picks up prize and swings back to position A, the grab 108 opens and deposits prize (when won). The crane mechanism is then ready for the next game.

Figure 3:
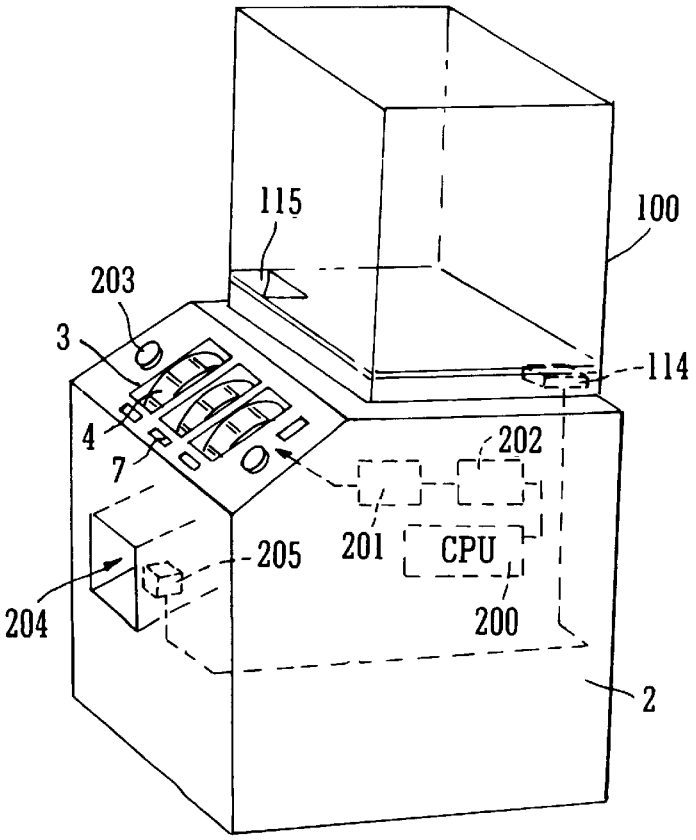
FIG. 3 is a perspective view of an amusement machine according to the invention comprising a chance/fruit machine.

Referring to drawing FIG. 3 and as explained in patent specification GB 2292246, the amusement machine comprises a base 2 containing a central processing unit (CPU) to control the amusement with prizes (AWP) game in addition to the CPU 114 to control the crane game.

The AWP game is a fruit machine with three rotatable drums 4 mounted in the casing 2 and coupled to rotation actuator means 201 and control and stop means 202. Each drum 4 has symbols on its periphery viewable through respective windows 3 in casing 2. The machine casing 2 also features a fruit machine start button 6, a coin slot 5 and, for each drum, a nudge button 7 as described earlier with reference to prior art fruit machines. Transparent casing 100 is incorporated with a top portion of the casing 2 as described with reference to patent specification GB 2292246. The crane mechanism and the rotating table are not shown in FIG. 3. The outlet chute 204 leading from payout receptacle 115 of the crane game contains s sensor 205 to sense whether or not a prize is won as described earlier and to transmit that information to the CPU 114. To start the movement cycle of crane arm 106, a button 203 is provided.

It is possible and convenient to have a single CPU for both games. The CPU for the AWP game is arranged such that a selected winning line will enable the player to play the crane game, the other wins providing a cash prize. The crane hand may be arranged to start movement electronically or the AWP may incorporate a supplementary gear wheel to cause such movement.

A crane of the invention takes one third of the time of the conventional to complete its cycle.

What is claimed is:

1. An amusement machine comprising a cabinet containing apparatus for playing a game of chance, and also containing:

a combination of a table and a crane mechanism for playing a further game when so enabled in response to a win on the game of chance, said table being disposed generally in the center of said cabinet and being operable for carrying a selection of prizes; and said crane mechanism comprising a column disposed at one side of said table, a crane arm mounted on the column, grab means adjacent one end of the crane arm, power means coupled to the crane arm and operable for moving the grab means from a starting position remote from said table to an operating position overlying said table, then to a discharge position further away from the center of said table than said operating position and overlying an outlet for discharge of a prize grabbed from said table and then for returning the crane arm to the starting position means, and grab actuating means coupled to the grab means and operable for actuating the grab means for grabbing a prize when in said operating position and for releasing said prize, if one has been grabbed, over said outlet.

2. A machine according to claim 1, wherein in the starting position the crane arm overlies the discharge outlet.

3. A machine according to claim 1, wherein the crane arm is arranged to move through an arc.

4. A machine according to claim 1, wherein the table is a turntable supported on an axle in the centre of the table.

5. A machine according to claim 1, wherein the game of chance is a fruit machine.

6. A machine according to claim 1, wherein the apparatus for playing a game of chance comprises control means operable for regulating the proportion of stake money paid out by the apparatus and said machine includes a sensor in the said outlet to detect whether or not a prize has been passed down the outlet and to pass that information to said control means.

7. An amusement machine comprising:

a cabinet;

a fruit machine incorporated within the cabinet and including means for presenting to a player a plurality of sequences of symbols and for halting the sequences with respective combinations of the symbols in view;

support means in the cabinet for supporting a selection of prizes;

outlet means incorporated in the cabinet for receiving a prize released into outlet means from within the cabinet and making said prize available for retrieval outside the cabinet;

a crane mechanism mounted inside the cabinet and including a movably mounted prize pick-up device and motorized drive means coupled to the pick-up device for causing the pick-up device to undergo a predetermined automatic sequence of operations including moving to a pick-up position at least near to said prize supporting means, operating to pick up a prize relative to which the pick-up means is suitably positioned when the pick-up means is operated, moving to a discharge position at least near said outlet means and releasing said prize into said outlet means; and switch means coupled to the fruit machine and said motorized drive means and operable by said player when a predetermined one of said combinations of the symbols is in view to start said predetermined automatic sequence of operations.

8. An amusement machine according to claim 7, wherein said switch means comprises a push button switch.

9. An amusement machine according to claim 7, wherein said prize support means comprises a horizontal table mounted for rotation about a vertical axis and a drive motor coupled to the table for rotating the table about said axis.

10. An amusement machine comprising:

a cabinet;

a fruit machine incorporated within the cabinet and including means for presenting to a player a plurality of sequences of symbols and for halting the sequences with respective combinations of the symbols in view;

a motor driven rotating table disposed generally at the centre of the cabinet for supporting a selection of prizes;

outlet means incorporated in the cabinet for receiving a prize released into outlet means from within the cabinet and making said prize available for retrieval outside the cabinet;

a crane mechanism mounted inside the cabinet and comprising a crane arm mounted for turning movement about a vertical axis at one end of the crane arm, a grab device coupled to the other end of the crane arm, and motorised drive means coupled to the crane arm and grab device for producing a predetermined automatic sequence of operations including turning movement of the crane arm for the grab device to move from a starting position to a prize pick-up position over said table, then movement of the grab device for grabbing a prize, and then reverse turning movement of the crane arm for the grab device to move over said outlet means and release a grabbed prize; and a push-button switch coupled to the fruit machine and said motorized drive means and operable by said player when a predetermined one of said combinations of the symbols is in view to start said sequence of operations.

* * * * *